US009818353B2

(12) United States Patent
So et al.

(10) Patent No.: US 9,818,353 B2
(45) Date of Patent: Nov. 14, 2017

(54) SCAN DRIVER ADN DISPLAY DEVICE USING THE SAME

(71) Applicant: LG DISPLAY CO., LTD., Seoul (KR)

(72) Inventors: Byeongseong So, Paju-si (KR); Seungho Heo, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 101 days.

(21) Appl. No.: 14/733,220

(22) Filed: Jun. 8, 2015

(65) Prior Publication Data

US 2015/0371598 A1 Dec. 24, 2015

(30) Foreign Application Priority Data

Jun. 23, 2014 (KR) ..... 10-2014-0076778

(51) Int. Cl.

| | |
|---|---|
| ***G09G 3/36*** | (2006.01) |
| ***G09G 3/32*** | (2016.01) |
| ***G09G 3/20*** | (2006.01) |

(52) U.S. Cl.

CPC ..... *G09G 3/3611* (2013.01); *G09G 3/20* (2013.01); *G09G 3/3677* (2013.01); *G09G 2230/00* (2013.01); *G09G 2310/0218* (2013.01); *G09G 2310/0267* (2013.01); *G09G 2310/0281* (2013.01); *G09G 2310/0286* (2013.01); *G09G 2310/0289* (2013.01); *G09G 2320/0223* (2013.01)

(58) Field of Classification Search

USPC ..... 377/64; 345/100

See application file for complete search history.

(56) References Cited

U.S. PATENT DOCUMENTS

2008/0002803 A1* 1/2008 Kim ..... G09G 3/006 377/64

2015/0340102 A1* 11/2015 Qian ..... G11C 19/184 377/54

FOREIGN PATENT DOCUMENTS

| | | |
|---|---|---|
| CN | 101089939 | 12/2007 |
| CN | 101097692 A | 1/2008 |
| CN | 101477836 A | 7/2009 |
| CN | 102110406 | 6/2011 |
| CN | 103280201 A | 9/2013 |
| CN | 103794181 A | 5/2014 |
| KR | 20090050358 A | 5/2009 |

* cited by examiner

*Primary Examiner* — Carolyn R Edwards
*Assistant Examiner* — Deeprose Subedi
(74) *Attorney, Agent, or Firm* — Dentons US LLP

(57) ABSTRACT

Disclosed is a display device that may include a display panel, a data driver configured to supply a data signal to the display panel, and a scan driver formed in a non-display area of the display panel, including a shift register composed of a plurality of stages and a level shifter formed outside the display panel, and configured to supply a scan signal to the display panel using the shift register and the level shifter, wherein the shift register is arranged in an output terminal of an N-th stage circuit unit formed in a first non-display area and an output terminal of an N-th compensation circuit unit formed in a second non-display area opposite the first non-display area are paired to be connected to an N-th scan line, wherein the N-th compensation circuit unit outputs a compensation signal to the N-th scan line in response to a node voltage of a neighboring stage circuit unit.

16 Claims, 14 Drawing Sheets

SCAN DRIVER ADN DISPLAY DEVICE USING THE SAME

This application claims the benefit of Korean Patent Application No. 10-2014-0076778, filed on Jun. 23, 2014, which is incorporated herein by reference for all purposes as if fully set forth herein.

BACKGROUND OF THE INVENTION

Field of the Invention

The present invention relates to a display device and a method of driving the same, and more particularly, to a scan driver of a display device.

Discussion of the Related Art

With the development of information technology, the market of display devices, which are interface media between users and information, is growing. Accordingly, display devices such as an organic light emitting display (OLED), a liquid crystal display (LCD) and a plasma display panel (PDP) are widely used.

Among the aforementioned display devices, the LCD or OLED, for example, includes a display panel having a plurality of sub-pixels arranged in a matrix and a driver for driving the display panel. The driver includes a scan driver for supplying a scan signal (or gate signal) to the display panel and a data driver for supplying a data signal to the display panel and the like.

Such a display device can display an image according to light emission of selected sub-pixels upon supply of scan signals and data signals to the sub-pixels arranged in a matrix form.

The scan driver can be categorized into an external scan driver mounted in the form of an integrated circuit on an external substrate of the display panel and an embedded scan driver formed in the display panel in the form of a gate in panel (GIP) which is formed through a thin film transistor process.

Such a conventional embedded scan driver may have, however, various problems such as propagation delay and gate floating due to the circuit characteristics, especially when the display device has a high resolution and large screen size.

SUMMARY OF THE INVENTION

Accordingly, the present invention is directed to provide a display device and method of driving the same that substantially obviates one or more problems due to limitations and disadvantages of the related art.

An advantage of the present invention is directed to provide a display device including a scan driver with improved picture quality.

Additional features and advantages of the invention will be set forth in the description which follows, and in part will be apparent from the description, or may be learned by practice of the invention. These and other advantages of the invention will be realized and attained by the structure particularly pointed out in the written description and claims hereof as well as the appended drawings.

To achieve these and other advantages and in accordance with the purpose of the present invention, as embodied and broadly described, a display device may, for example, include a display panel having a display area and a non-display area outside the display area; a data driver that supplies a data signal to the display panel; and a scan driver in the non-display area that includes a shift register of a plurality of stages and a level shifter, and that supplies a scan signal to the display panel using the shift register and the level shifter, wherein the shift register is arranged in an output terminal of an N-th stage circuit in a first non-display area and an output terminal of an N-th compensation circuit in a second non-display area that is in an opposite side of the first non-display area with the display area therebetween are paired and connected to an N-th scan line, wherein the N-th compensation circuit outputs a compensation signal to the N-th scan line in response to a node voltage of an immediately neighboring stage circuit.

According to another aspect of the present invention, there is provided a scan driver, including: a level shifter; and a shift register composed of a plurality of stages to generate a scan signal on the basis of a signal and power output from the level shifter, wherein the shift register includes an N-th stage circuit unit and an N-th compensation circuit unit located on the same line as the N-th stage circuit unit, the N-th stage circuit unit and the N-th compensation circuit unit being arranged to have asymmetrical circuit configurations, wherein an output terminal of the N-th stage circuit unit and an output terminal of the N-th compensation circuit unit are paired to be connected to an N-th scan line, wherein the N-th compensation circuit unit outputs a compensation signal to the N-th scan line in response to a node voltage of a neighboring stage circuit unit.

According to another aspect of the present invention, there is provided a display device, including: a display panel; a data driver configured to supply a data signal to the display panel; and a scan driver formed in a non-display area of the display panel, including a shift register composed of a plurality of stages and a level shifter formed outside the display panel, and configured to supply a scan signal to the display panel using the shift register and the level shifter, wherein the shift register is arranged in an output terminal of an N-th stage circuit unit formed in a first non-display area and an output terminal of an N-th compensation circuit unit formed in a second non-display area opposite the first non-display area are paired to be connected to an N-th scan line, wherein the N-th compensation circuit unit maintains the N-th scan line at a scan low voltage in response to a clock signal having a logic state opposite an N-th clock signal output through the output terminal of the N-th stage circuit unit.

According to another aspect of the present invention, there is provided a scan driver, including: a level shifter; and a shift register composed of a plurality of stages to generate a scan signal on the basis of a signal and power output from the level shifter, wherein the shift register includes an N-th stage circuit unit and an N-th compensation circuit unit located on the same line as the N-th stage circuit unit, the N-th stage circuit unit and the N-th compensation circuit unit being arranged to have asymmetrical circuit configurations, wherein an output terminal of the N-th stage circuit unit and an output terminal of the N-th compensation circuit unit are paired to be connected to an N-th scan line, wherein the N-th compensation circuit unit maintains the N-th scan line at a scan low voltage in response to a clock signal having a logic state opposite an N-th clock signal output through the output terminal of the N-th stage circuit unit.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE ILLUSTRATED EMBODIMENTS

Reference will now be made in detail to embodiments of the present invention, examples of which are illustrated in the accompanying drawings. The same reference numbers may be used throughout the drawings to refer to the same or like parts.

First Embodiment

Figure 1:
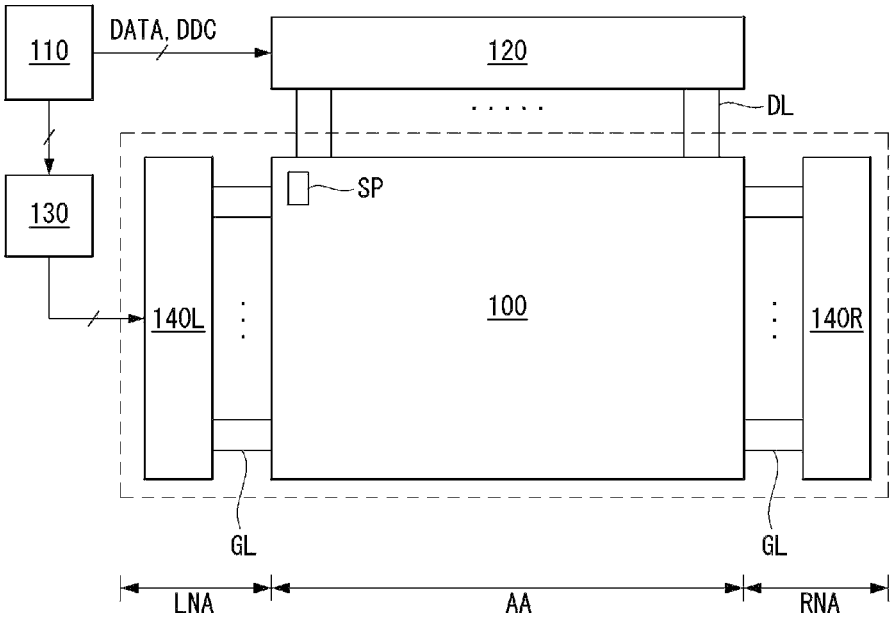
FIG. 1 is a block diagram of a display device.
Figure 2:
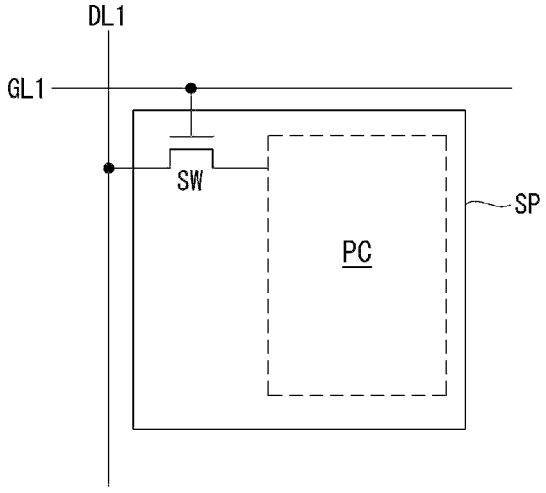
FIG. 2 illustrates a configuration of a sub-pixel of in FIG. 1.

FIG. 1 a block diagram of a display device and FIG. 2 illustrates a configuration of a sub-pixel of the display device illustrated in FIG. 1.

As illustrated in FIG. 1, the display device includes a display panel 100, a timing controller 110, a data driver 120 and a scan driver 130, 140L and 140R.

The display panel 100 further includes a plurality of sub-pixels connected to data lines DL and scan lines GL crossing the data lines DL. The display panel 100 includes a display area AA in which the sub-pixels are formed and non-display areas LNA and RNA outside the display area AA, in which signal lines, pads and the like are formed. The display panel 100 may be implemented as an LCD, an OLED, an electrophoretic display (EPD) and the like.

Referring to FIG. 2, one sub-pixel SP includes a switching transistor SW connected to a first scan line GL1 and a first data line DL1 and a pixel circuit PC operating according to a data signal DATA supplied in response to a scan signal provided through the switching transistor W. The sub-pixels may constitute an LCD panel including liquid crystal elements, or an OLED panel including organic light-emitting elements or the like according to their known configurations of the pixel circuit PC.

When the display panel 100 is an LCD panel, the display panel 100 is implemented in a TN (Twisted Nematic) mode, VA (Vertical Alignment) mode, IPS (In Plane Switching) mode, FFS (Fringe Field Switching) mode or ECB (Electrically Controlled Birefringence) mode. When the display panel 100 is an OLED panel, the display panel 100 is implemented in a top-emission mode, bottom-emission mode or dual-emission mode.

The timing controller 110 receives timing signals such as a vertical synchronization signal, a horizontal synchronization signal, a data enable signal and a dot clock signal through an LVDS or TMDS interface circuit connected to a video board. The timing controller 110 generates timing control signals for controlling operation timing of the data driver 120 and the scan driver 130, 140L and 140R on the basis of the timing signals input thereto.

The data driver 120 includes a plurality of source drive integrated circuits (ICs). The source drive ICs receive a data signal DATA and a source timing control signal DDC from the timing controller 110. The source drive ICs convert the data signal DATA from a digital signal into an analog signal in response to the source timing control signal DDC and supply the analog signal through the data lines DL of the display panel 100. The source drive ICs are connected to the data lines DL of the display panel 100 through a COG (Chip On Glass) or TAB (Tape Automated Bonding) process.

The scan driver 130, 140L and 140R includes a level shifter 130 and shift registers 140L and 140R. The scan driver 130, 140L and 140R is formed in a gate in panel (GIP) structure in which the level shifter 130 and the shift registers 140L and 140R are separately formed.

The level shifter 130 is formed on an external substrate connected to the display panel 100 in the form of an IC. The level shifter 130 shifts levels of signals and power, supplied through a clock signal line, a start signal line, a high-level power line and a low-level power line, under the control of the timing controller 11 and then provides the signals and power to the shift registers 140L and 140R.

The shift registers 140L and 140R are formed in the non-display areas LNA and RNA of the display panel 100 in the form of thin film transistors in a GIP structure. The shift registers 140L and 140R are respectively formed in the non-display areas LNA and RNA of the display panel 100. The shift registers 140L and 140R are composed of stage circuit units that shift and output scan signals in response to the signals and power supplied from the level shifter 130. The stage circuit units included in the shift registers 140L and 140R sequentially output scan signals through output terminals.

In the aforementioned embedded scan driver where the level shifter 130 and the shift registers 140L and 140R are separately formed, the shift registers 140L and 140R are implemented by oxide or amorphous silicon thin film transistors and the like. The oxide thin film transistor has excellent current transfer characteristics, and thus, a circuit size can be reduced compared to the amorphous silicon thin film transistor. The amorphous silicon thin film transistor has excellent threshold voltage recovery characteristics against stress bias, compared to the oxide thin film transistor, since the threshold voltage thereof can be maintained uniform.

Figure 3:
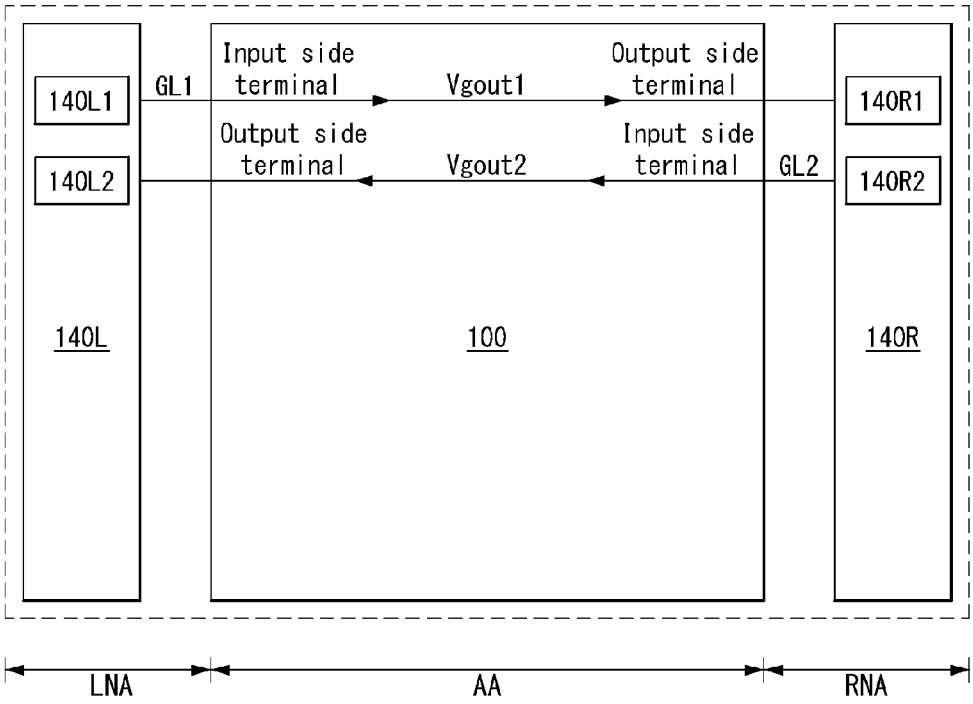
FIG. 3 illustrates an exemplary arrangement of shift registers on the left and right sides of a display panel.
Figure 4:
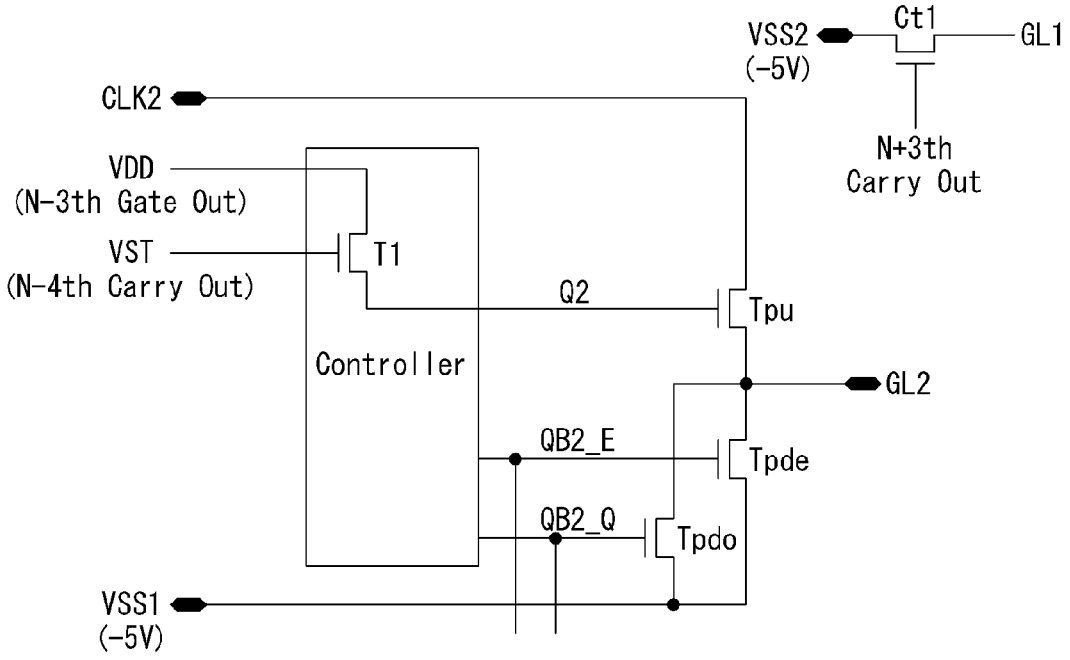
FIG. 4 illustrates a circuit of a principal part of a shift register according to a first experimental example.
Figure 5:
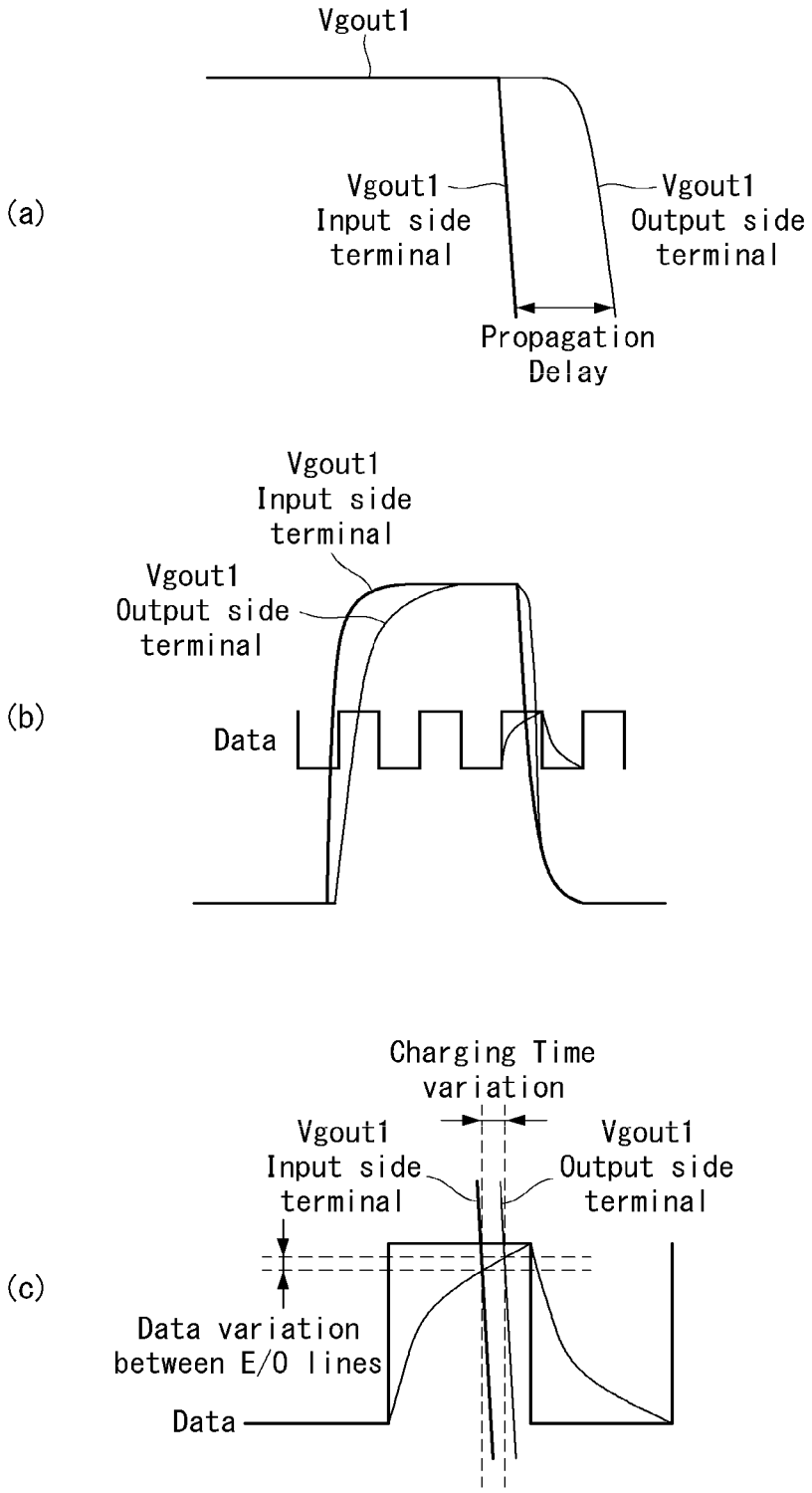
FIG. 5 is a waveform diagram explaining problems of the shift register illustrated in FIG. 4.

FIG. 3 illustrates an exemplary arrangement of the shift registers on the left and right sides of the display panel, FIG. 4 illustrates a circuit of a principal part of the shift register according to a first experimental example, and FIG. 5 is a waveform diagram for explaining problems of the shift register shown in FIG. 4.

As shown in FIG. 3, the embedded scan driver is implemented in a structure in which the shift registers 140L and 140R are respectively arranged in the left and right non-display areas LNA and RNA of the display panel. When the embedded scan driver is formed as shown in FIG. 3, various advantages can be obtained when the display device has a high resolution and large screen size.

When the left and right shift registers 140L and 140R are configured as shown above, a first scan signal Vgout1 output from a unit 140L1 is supplied to the display panel 100 through an input side terminal and transferred to a unit 140R1 located opposite the unit 140L1 through an output side terminal. In this manner, a second scan signal Vgout2 output from a unit 140R2 is supplied to the display panel 100 through an input side terminal and transferred to a unit 140L2 located opposite the unit 140R2 through an output side terminal.

That is, when the left shift register 140L outputs a scan signal in the first line, the right shift register 140R outputs a scan signal in the second line. In this manner, the left and right shift registers 140L and 140R alternately output scan signals line by line and thus a scan signal output direction has a zigzag form.

First Experimental Example

Referring to FIGS. 4 and 5, in order to implement an embedded scan driver capable of compensating for charge variation of sub-pixels, a first compensation circuit unit Ct1 is provided to the unit 140R1 of FIG. 3 and a stage circuit unit T1, Tpu, Tpde and Tpdo is provided to the unit 140R2 of FIG. 3 in the first experimental example. That is, in the scan driver, the circuits located at the first and second sides of the same scan line are formed in an asymmetrical form.

In the first experimental example, the first compensation circuit unit Ct1 provided to the unit 140R1 is used to compensate for a scan signal off voltage Voff (or scan low voltage). The first compensation circuit unit Ct1 operates to output a second low-level voltage, delivered through a second low-level power line VSS2, to the first scan line GL1 in response to a carry signal (N+3)-th Carry Out output from an (N+3)-th stage circuit.

The first compensation circuit unit Ct1 is connected to the second low-level power line VSS2, and the stage circuit unit T1, Tpu, Tpdo, Tode is connected to a first low-level power line VSS1 in the example shown in FIG. 4. However, since the same voltage, for example, −5V, is supplied through the first low-level power line VSS1 and the second low-level power line VSS2, the first compensation circuit unit Ct1 and the stage circuit unit T1, Tpu, Tpdo, Tpde may be integrated.

The configuration such as the first compensation circuit unit Ct1 used in the first experimental example causes a propagation delay between an input terminal and an output terminal when the first scan signal Vgout1 as shown in FIG. 5(*a*) is supplied.

Such a propagation delay causes a charge variation of the sub-pixels, as shown in FIGS. 5(*b*) and (*c*), and the sub-pixels are charged with different voltages due to variation between an odd-numbered QB node and an even-numbered QB node (data variation between E/O lines) caused by a data signal delay, and thus, a line dimming (display quality deterioration) may occur. Such a line dimming increases as the resolution of the display panel increases.

As described above, the embedded scan driver according to the first experimental example causes a propagation delay, and thus, the circuit reliability and picture quality of the display device deteriorate.

A display device according to the first embodiment of the present invention provides a compensation circuit unit for improving and compensating for such a propagation delay.

First Embodiment

Figure 6:
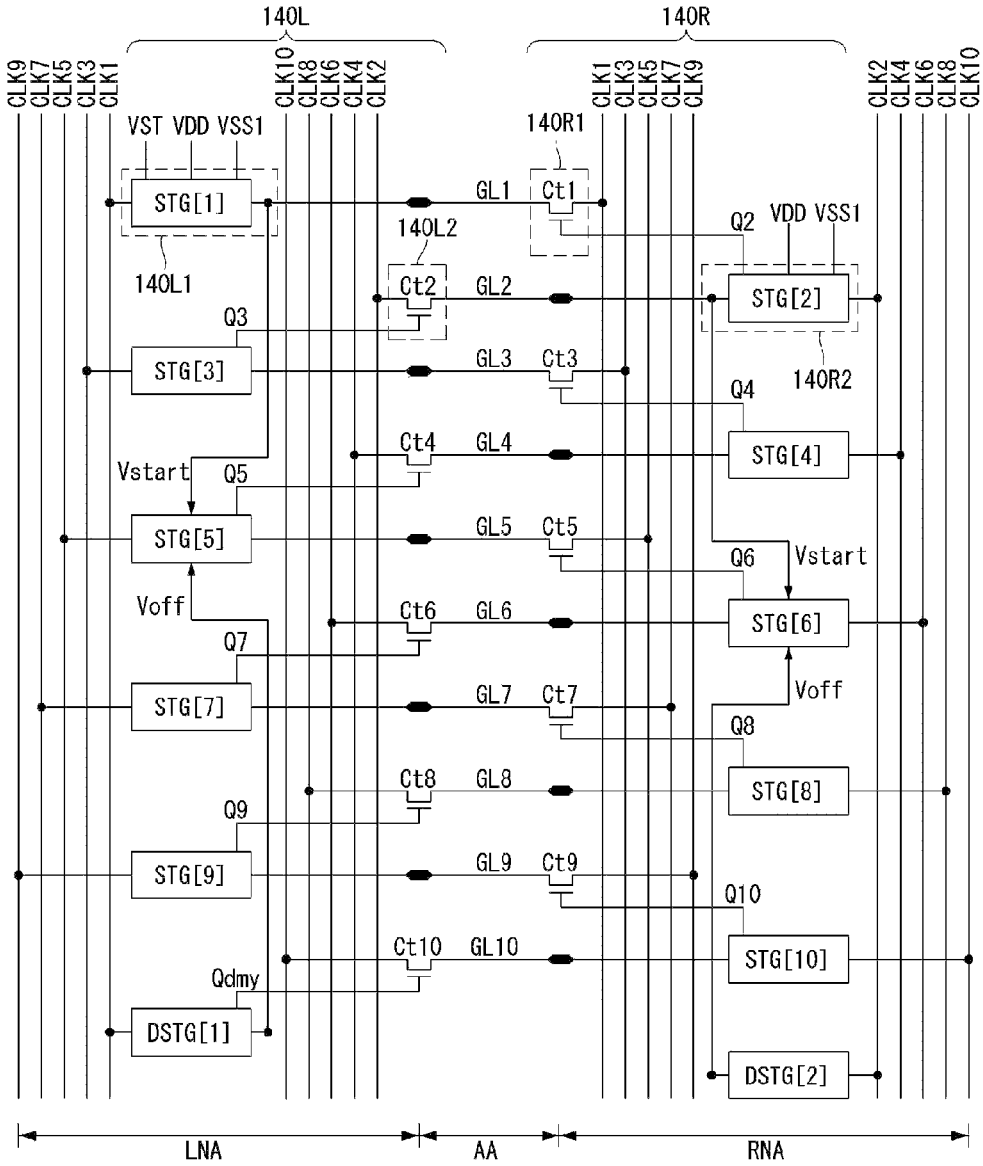
FIG. 6 illustrates shift registers of an embedded scan driver according to the first embodiment of the present invention.
Figure 7:
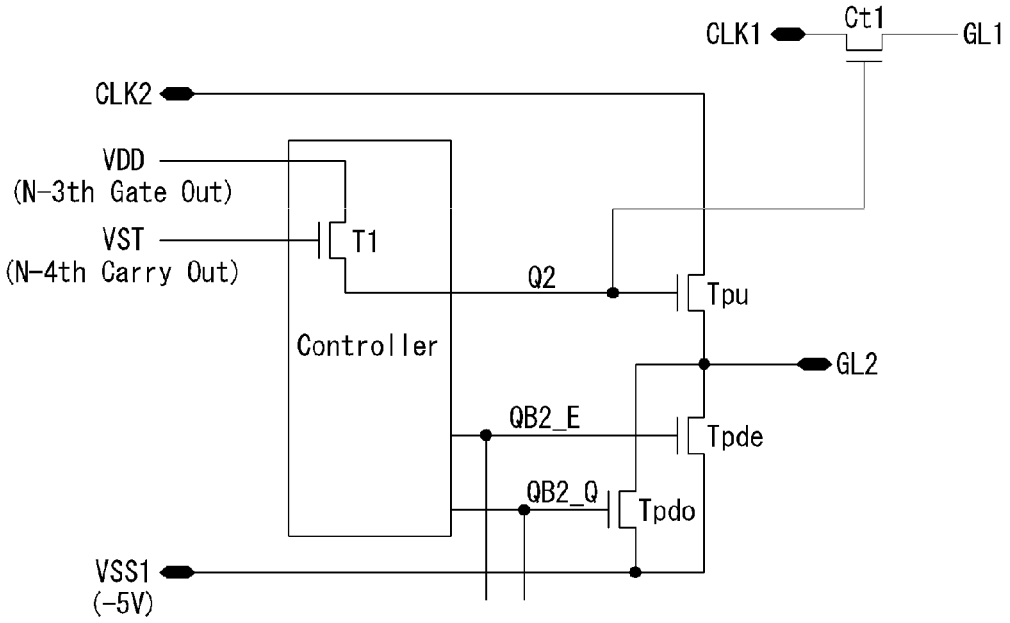
FIG. 7 illustrates a circuit of a principal part of a shift register according to the first embodiment of the present invention.
Figure 8:
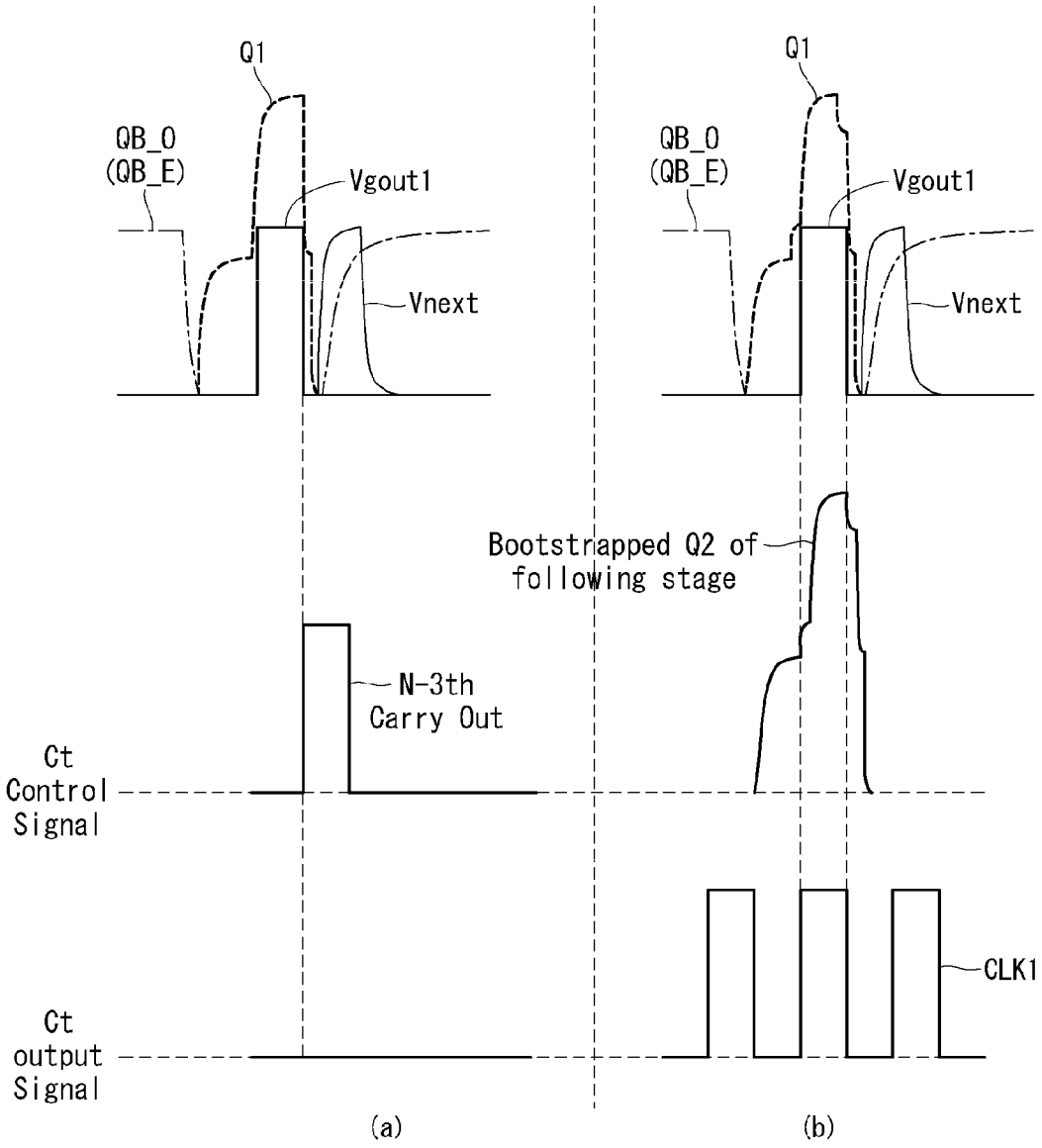
FIG. 8 is a waveform diagram explaining improvement of the shift register according to the first embodiment of the present invention, compared to the first experimental example.
Figure 9:
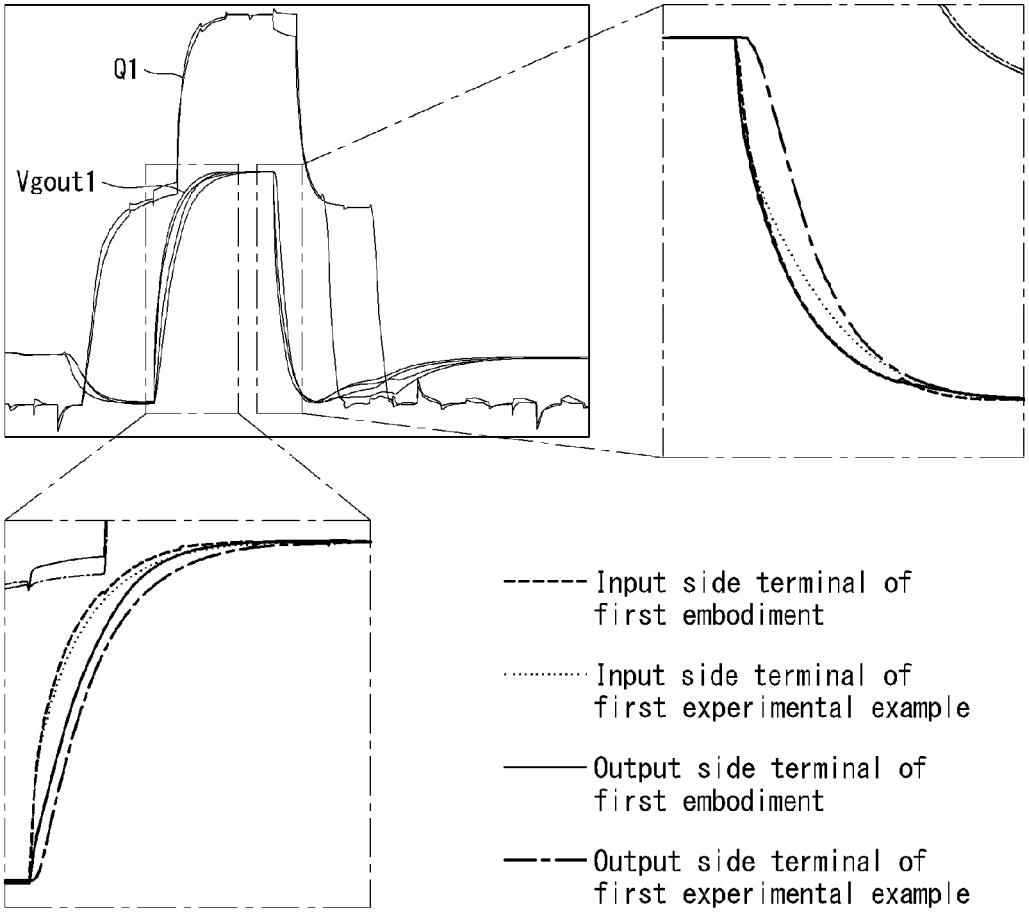
FIG. 9 is a simulation waveform diagram showing different output signals of shift registers between the first experimental example and the first embodiment of the present invention.

FIG. 6 illustrates a shift register of an embedded scan driver according to the first embodiment of the present invention, FIG. 7 shows a circuit of a principal part of the shift register according to the first embodiment of the present invention, FIG. 8 is a waveform diagram for explaining improvement of the shift register according to the first embodiment of the present invention, compared to the first experimental example, and FIG. 9 is a simulation waveform diagram showing different output signals of shift registers between the first experimental example and the first embodiment of the present invention.

As illustrated in FIG. 6, the embedded scan driver according to the first embodiment of the present invention includes left and right shift registers 140L and 140R respectively formed in left and right non-display areas LNA and RNA of the display area AA.

The left and right shift registers 140L and 140R include a plurality of stage circuit units STG[1] to STG[10], a plurality of dummy stage circuit units DSTG[1] and DSTG[2]) and a plurality of compensation circuit units Ct1 to Ct10. That is, the embedded scan driver is formed in such a manner that circuits are asymmetrically located at the first and second sides of the same scan line.

The stage circuit units STG[1] to STG[10] and the dummy state circuit units DSTG[1] and DSTG[2] operate in response to signals and power supplied through clock signal lines CLK1 to CLK10, a start signal line VST, a high-level power line VDD and a low-level power line VSS1.

The stage circuit units STG[1] to STG[10] are composed of transistors which operate in response to the signals and power supplied through the clock signal lines CLK1 to CLK10, the start signal line VST, the high-level power line VDD and the low-level power line VSS1. The transistors include a controller for controlling a Q node and a QB node (including an odd-numbered QB node and an even-numbered QB node), a pull-up transistor and a pull-down transistor that output scan signals in response to operation of the controller. The pull-up transistor outputs a scan signal corresponding to a scan high voltage and the pull-down transistor outputs a scan signal corresponding to a scan low voltage.

The number of transistors constituting the stage circuit units STG[1] to STG[10] and connection relationship therebetween vary depending on compensation methods. In the first embodiment of the present invention, the controller for controlling the Q node and the QB node (including an odd-numbered QB node and an even-numbered QB node) is briefly illustrated.

While FIG. 6 illustrates that the ten clock signal lines CLK1 to CLK10 are arranged on both sides of the stage circuit units STG[1] to STG[10] with fives clock signal lines provided to each side, this is exemplary and the present invention is not limited thereto.

The stage circuit units STG[1] to STG[10] are respectively connected to the scan lines and alternately formed in the left and right non-display areas LNA and RNA of the display area AA. For example, the first stage circuit unit STG[1] is arranged in the left non-display area LNA and the output terminal thereof is connected to a first scan line GL1. The second stage circuit unit STG[2] is arranged in the right non-display area RNA and the output terminal thereof is connected to a second scan line GL2.

In this manner, odd-numbered stage circuit units including the third, fifth, seventh and ninth stage circuit units STG[3], STG[5], STG[7] and STG[9] are arranged in the left non-display area LNA and even-numbered stage circuit units including the fourth, sixth, eighth and tenth stage circuits STG[4], STG[6], STG[8] and STG[10] are arranged in the right non-display area RNA. In addition, the stage circuit units STG[1] to STG[10] respectively output scan signals through the first to tenth scan lines GL1 to GL10 respectively connected to the output terminals thereof.

As illustrated in FIG. 6, the stage circuit units STG[1] to STG[10] or the dummy stage circuit units DSTG[1] and DSTG[2] included in the left and right shift registers 140L and 140R are arranged to form pairs with the compensation circuit units Ct1 to Ct10.

For example, the first stage circuit unit STG[1] and the first compensation circuit unit Ct1 are respectively arranged on the left and right sides of the display area AA, opposite each other, and connected to the first scan line GL1 to be paired, as shown by 140L1. The second stage circuit unit STG[2] and the second compensation circuit unit Ct2 are respectively arranged on the left and right sides of the display area AA, opposite each other, and connected to the second scan line GL2 to be paired, as shown by 140R2.

In this manner, other stage circuit units and compensation circuit units are paired by being connected to the same scan lines to which the stage circuit units and compensation circuit units are arranged. In addition, the dummy stage circuit units DSTG[1] and DSTG[2] and compensation circuit units are paired by being connected to the same scan lines to which the dummy stage circuit units and compensation circuit units are arranged.

The dummy stage circuit units DSTG[1] and DSTG[2] are configured in a similar or identical manner. The dummy stage circuit units DSTG[1] and DSTG[2] are alternately arranged in the left and right non-display areas LNA and RNA of the display area AA on every other line. The dummy stage circuit units DSTG[1] and DSTG[2] are arranged on upper or lower lines than the lines to which the stage circuit units STG[1] to STG[10] are arranged. In the figure, however, the dummy stage circuit units DSTG[1] and DSTG[2] are arranged to lower lines than the lines to which the stage circuit units STG[1] to STG[10] are arranged.

The stage circuit units STG[1] to STG[10] output dummy signals Qdmy for controlling specific stages and do not output scan signals through the scan lines formed in the display panel. That is, the output terminals of the stages STG[1] to STG[10] are not connected to the scan lines formed in the display panel.

The compensation circuit units Ct1 to Ct10 are provided to the ends of the output terminals of the stage circuit units STG[1] to STG[10] and the dummy stage circuit units DSTG[1] and DSTG[2], and operate in response to voltages of nodes (e.g. Q nodes such as Q2 to Qdmy) of neighboring stage circuit units. For example, the first compensation circuit unit Ct1 is arranged in the right non-display area RNA opposite the first stage circuit unit STG[1]. Here, the first compensation circuit unit Ct1 is connected to operate in response to Q2 node voltage Q2 of the second stage circuit unit STG[2] which is adjacent thereto in the vertical direction. The second compensation circuit unit Ct2 is arranged in the left non-display area LNA opposite the second stage circuit unit STG[2]. Here, the second compensation circuit unit Ct2 is connected to operate in response to Q3 node voltage Q3 of the third stage circuit unit STG[3] which is adjacent thereto in the vertical direction.

As described above, the compensation circuit units Ct1 to Ct10 output compensation signals (specific clock signals) to scan lines related (or connected) thereto in response to node voltages of neighboring stage circuit units. The compensation signals (specific clock signals) output from the compensation circuit units Ct1 to Ct10 are used to improve propagation delay of the embedded scan driver, which will be described below.

As illustrated in FIG. 7, to implement the embedded scan driver capable of compensating for charge variation of sub-pixels, the first compensation circuit unit Ct1 is provided to the side 140R1 of FIG. 6 and the second stage circuit unit T1, Tpu, Tpde, Tpdo is provided to the side 140R2 of FIG. 6 in the first embodiment.

In the first embodiment, the first compensation circuit unit Ct1 provided to the side 140R1 is used to compensate for a scan signal off voltage Voff (or scan low voltage). The first compensation circuit unit Ct1 is composed of a transistor that operates to output a first clock signal transferred through the first clock signal line CLK1 to the first scan line GL1 in response to Q2 node voltage Q2 of the second stage circuit unit T1, Tpu, Tpde, Tpdo.

The first compensation circuit unit Ct1 and the second stage circuit unit T1, Tpu, Tpde, Tpdo will now be described in detail.

The first compensation circuit unit Ct1 includes a compensation transistor Ct1 having a gate electrode connected to the Q2 node of the second stage circuit unit T1, Tpu, Tpde, Tpdo, a first electrode connected to the first clock signal line CLK1 and a second electrode connected to the first scan line GL1. The first compensation circuit unit Ct1 outputs a specific clock signal through a scan line related thereto in response to Q node voltage of a neighboring stage circuit unit.

The second stage circuit unit T1, Tpu, Tpde, Tpdo includes a controller, a pull-up transistor Tpu, a first pull-down transistor Tpdo and a second pull-down transistor Tpde. The controller includes a first transistor T1 having a gate electrode connected to the start signal line VST or a carry output terminal (N−4)-th Carry Out of the (N−4)-th stage circuit unit, a first electrode connected to the high-level power line VDD or the output terminal (N−3)-th Gate Out of the (N−3)-th stage circuit unit, and a second electrode connected to the Q2 node.

The pull-up transistor Tpu has a gate electrode connected to the Q2 node, a first electrode connected to the second clock signal line CLK2 and a second electrode connected to the output terminal of the second stage circuit unit T1, Tpu, Tpde, Tpdo. The pull-up transistor Tpu outputs a second clock signal supplied through the second clock signal line CLK2 as a scan signal corresponding to a scan high voltage in response to the voltage of the Q2 node.

The first pull-down transistor Tpdo has a gate electrode connected to an odd-numbered QB node QB2_O, a first electrode connected to the first low-level power line VSS1 and a second electrode connected to the output terminal of the second stage circuit unit T1, Tpu, Tpde, Tpdo. The first pull-down transistor Tpdo outputs a first low-level voltage supplied through the first low-level power line VSS1 as a scan signal corresponding to a scan low voltage in response to the voltage of the odd-numbered QB node QB2_O.

The second pull-down transistor Tpde has a gate electrode connected to an even-numbered QB node QB2_E, a first electrode connected to the first low-level power line VSS1 and a second electrode connected to the output terminal of the second stage circuit unit T1, Tpu, Tpde, Tpdo. The second pull-down transistor Tpde outputs the first low-level voltage supplied through the first low-level power line VSS1 as a scan signal corresponding to the scan low voltage in response to the voltage of the even-numbered QB node QB2_E.

The first pull-down transistor Tpdo and the second pull-down transistor Tpde alternately operate at least once per frame according to the controller that controls the odd-numbered QB node QB2_O and the even-numbered QB node QB2_E.

Referring to FIG. 8(*a*), a compensation circuit unit Ct operates in response to the carry signal (N+3)-th Carry Out output from the output terminal of the (N+3)-th stage circuit unit in the first experimental example. The compensation circuit unit Ct outputs a second low-level voltage to a scan line related thereto.

Referring to FIG. 8(*b*), the compensation circuit unit Ct operates in response to the Q2 node (bootstrapped Q2) of a neighboring following stage in the first embodiment. The compensation circuit unit Ct outputs the first clock signal CLK1 to a scan line related thereto.

In the first experimental example, the compensation circuit unit Ct operates in response to a carry signal of a stage circuit unit spaced apart therefrom, and thus it may be difficult to properly supply a compensation signal to a scan line related to the compensation circuit unit Ct. In the first embodiment, however, timing at which the compensation circuit unit Ct can properly supply a compensation signal to a scan line related thereto is defined since the compensation circuit unit Ct operates in response to a bootstrapped Q2 node voltage of a neighboring stage circuit unit.

In addition, a propagation delay may occur in the first experimental example since the compensation circuit Ct uses the second low-level voltage that may cause a voltage drop in response to node or line characteristics. In the first embodiment of the present invention, the compensation circuit unit Ct uses a clock signal that is less affected by node or line characteristics and thus the propagation delay problem can be addressed by improving signal rising and/or falling time.

The differences between the first experimental example and the first embodiment in the above description will be illustrated with reference to the simulation waveform diagram of FIG. 9.

Operation of the compensation circuit unit Ct in response to a Q node voltage of a neighboring stage circuit unit is exemplified in the above description. However, this is exemplary and the compensation circuit unit Ct may be, for example, implemented in the following modified form.

Figure 10:
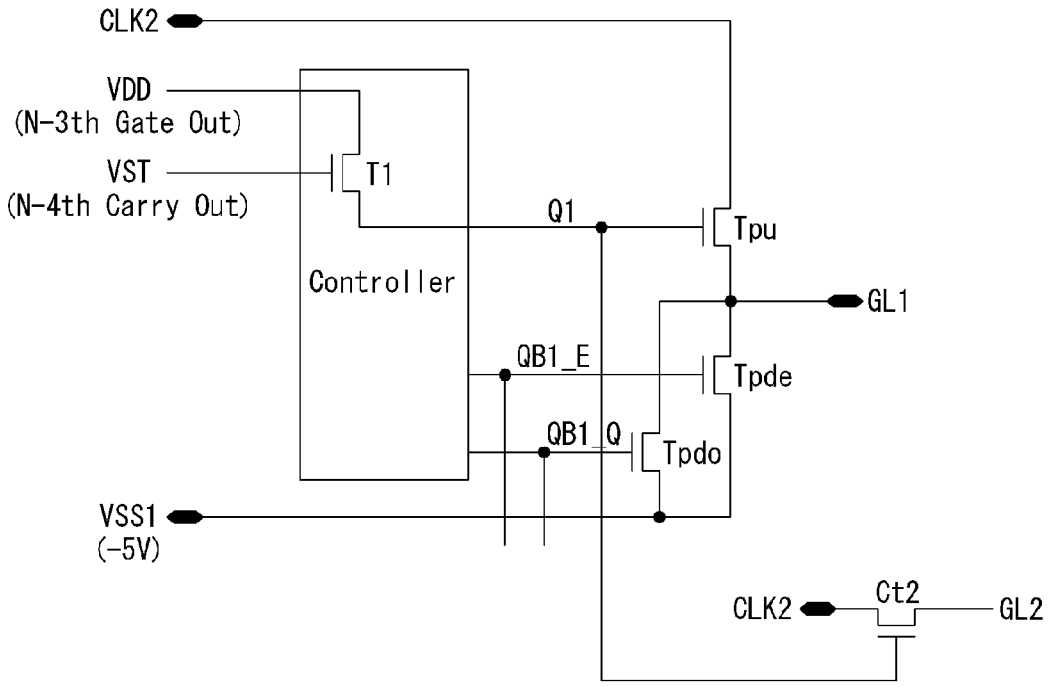
FIG. 10 illustrates a circuit of a principal part of a shift register according to a first modification of the first embodiment of the present invention.
Figure 11:
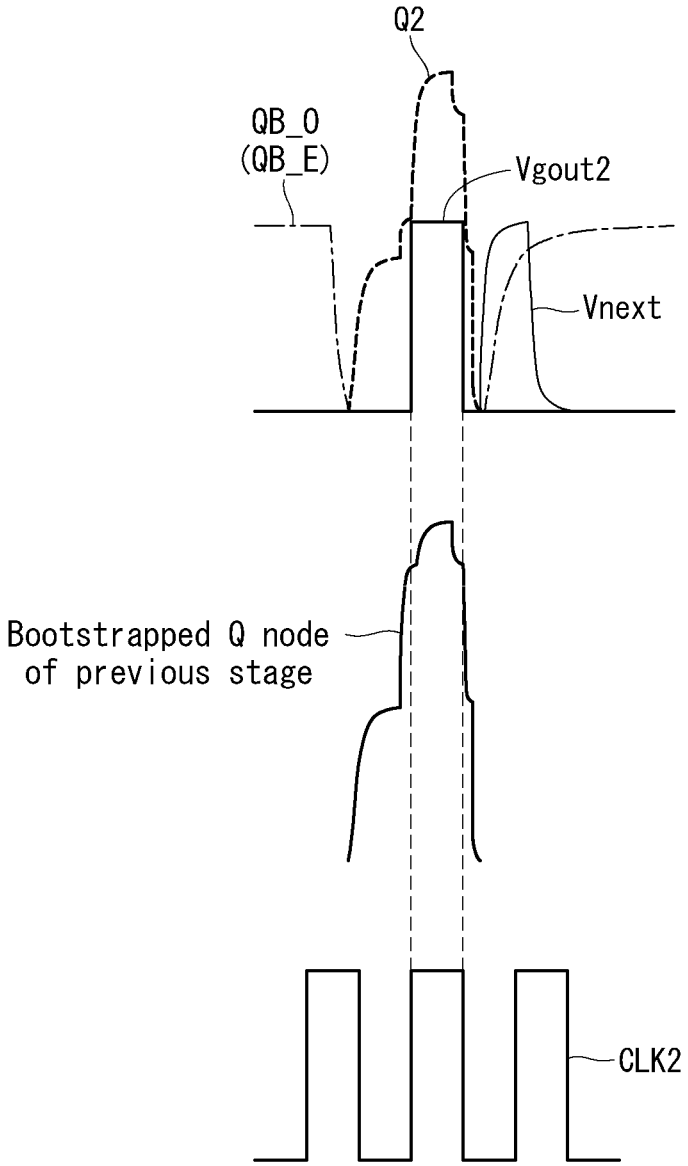
FIG. 11 is a waveform diagram explaining improvement of the shift register according to the first modification of the first embodiment of the present invention.
Figure 12:
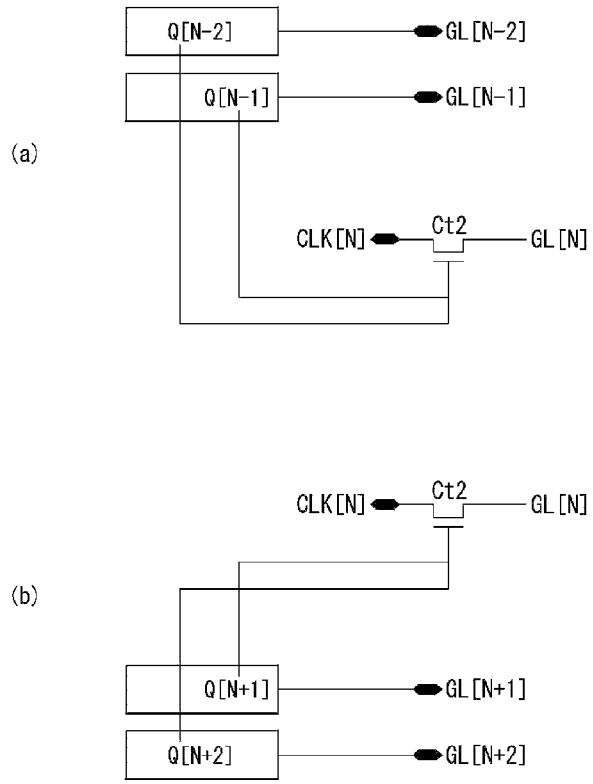
FIG. 12 illustrates a circuit of a principal part of a shift register according to a second modification of the first embodiment of the present invention.
Figure 13:
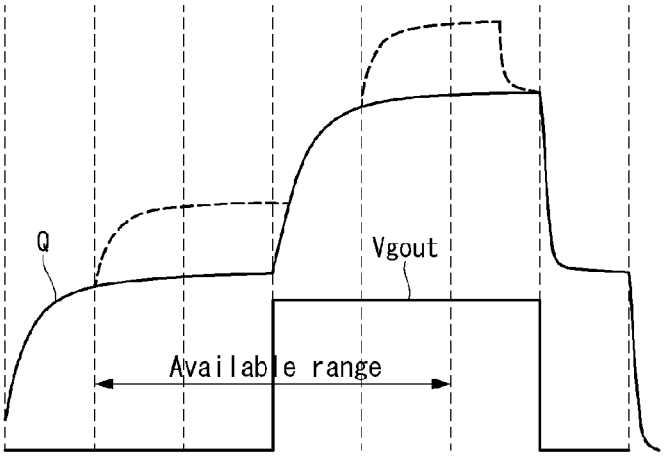
FIG. 13 illustrates an available range according to use of Q nodes.

FIG. 10 illustrates a circuit of a principal part of a shift register according to a first modification of the first embodiment of the present invention, FIG. 11 is a waveform diagram for explaining improvement of the shift register according to the first modification of the first embodiment of the present invention, FIG. 12 illustrates a circuit of a principal part of a shift register according to a second modification of the first embodiment of the present invention, and FIG. 13 illustrates an available range according to use of Q nodes.

As illustrated in FIG. 10, according to the first modification of the first embodiment of the present invention, the second compensation circuit unit Ct2 has a gate electrode connected to a node Q1 of the first stage circuit unit T1, Tpu, Tpde, Tpdo located in a stage before the second compensation circuit unit Ct2, a first electrode connected to the second clock signal line and a second electrode connected to the second scan line GL2.

In the first modification of the first embodiment, the second compensation circuit unit Ct2 operates in response to the node Q1 of the first stage circuit unit T1, Tpu, Tpde, Tpdo located in the stage before the second compensation circuit unit Ct2. FIG. 11 shows that the first modification of the first embodiment can exhibit similar or the same effects as the first embodiment.

In the case of a 3H overlap operation in which clock signals supplied through dock signal lines are overlapped for a period of 3H, in addition to the first modification, the second compensation circuit unit Ct2 may be implemented as in the second modification.

As illustrated in FIG. 12(*a*), according to the second modification of the first embodiment of the present invention, the gate electrode of the second compensation circuit unit Ct2 is connected to a Q node Q[N−1] of the (N−1)-th stage circuit unit and a Q node Q[N−2] of the (N−2)-th stage circuit unit, the first electrode thereof is connected to an N-th clock signal line CLK[N] and the second electrode thereof is connected to an N-th scan line GL[N].

In the second modification of the first embodiment, the second compensation circuit unit Ct2 is connected to both the Q nodes Q[N−1] and Q[n−2] of the stage circuit units located in stages before the second compensation circuit unit Ct2 and operates in response to the voltages of the Q nodes.

As illustrated in FIG. 12(*b*), according to the second modification of the first embodiment of the present invention, the gate electrode of the second compensation circuit unit Ct2 is connected to a Q node Q[N+1] of the (N+1)-th stage circuit unit and a Q node Q[N+2] of the (N+2)-th stage circuit unit, the first electrode thereof is connected to the N-th clock signal line CLK[N] and the second electrode thereof is connected to the N-th scan line GL[N].

In the second modification of the first embodiment, the second compensation circuit unit Ct2 is connected to both the Q nodes Q[N+1] and Q[n+2] of the stage circuit units located in stages following the second compensation circuit unit Ct2 and operates in response to the voltages of the Q nodes Q[N+1] and Q[n+2].

In the case of overlap operations in which clock signals supplied through clock signal lines are overlapped for 4H, 5H and 6H periods instead of 3H period, an available Q node range may increase as shown in FIG. 13.

As described above, the first embodiment of the present invention can address the propagation delay problem especially for a high resolution and large-sized display device. In addition, the first embodiment of the present invention compensates for the scan signal off voltage Voff (or scan low voltage) by supplying a clock signal (or dummy clock signal) to a scan line in response to the voltage of a bootstrapped Q node of the following stage, and thus a scan signal distortion can be addressed. Further, the first embodiment of the present invention can reduce the size of a buffer transistor or a compensation transistor in circuit design, because the scan signal off voltage Voff (or scan low voltage) is compensated by supplying a clock signal (or dummy clock signal) to a scan line.

In the first embodiment of the present invention, an example for improving and addressing the propagation delay problem in a scan driver, which is embedded in a display device having a high resolution and large size screen, has been described. However, when such an embedded scan driver using only one QB node is implemented, a gate floating, which may be generated at the output terminal of the shift register due to an increased load of the display panel, may also need to be considered. This will be described below. In the second embodiment, a node controller of a stage circuit unit may be similar to that of the first embodiment, but a node controller according to the present invention is not limited thereto.

Second Embodiment

In the second embodiment of the present invention, an experiment was carried out to improve deterioration of circuit reliability and picture quality due to a gate floating generated at the output terminal of the shift register, when an embedded scan driver using only one QB node is implemented.

Figure 14:
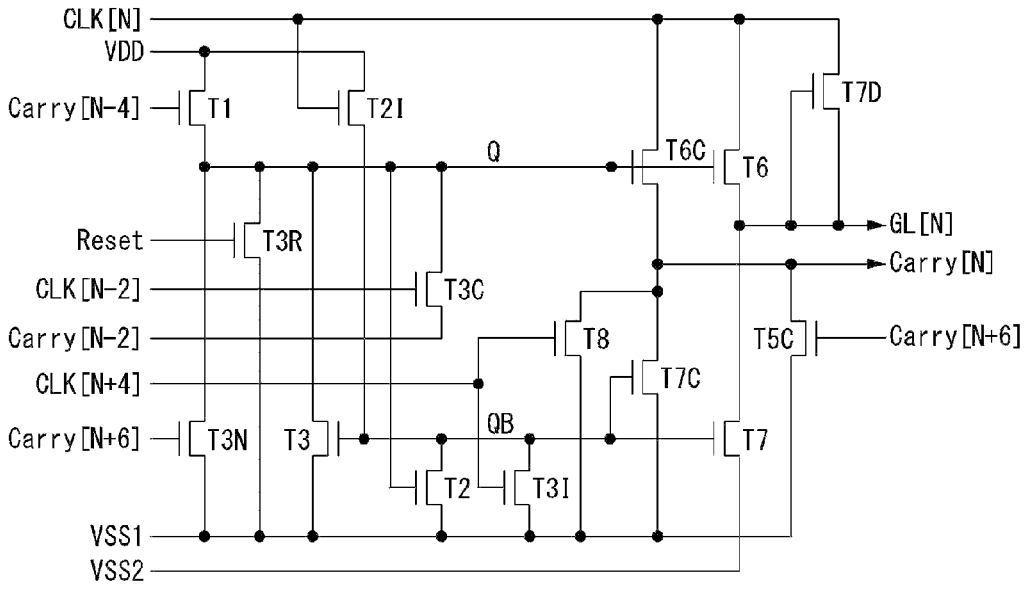
FIG. 14 illustrates a circuit of a principal part of a shift register according to a second experimental example.

FIG. 14 shows a circuit of a principal part of a shift register according to a second experimental example.

Second Experimental Example

As illustrated in FIG. 14, the shift register according to the second experimental example includes a pull-down transistor T7 operating in response to the voltage of one QB node. In addition, the shift register according to the second experimental example is implemented such that a carry output terminal Carry[n] through which a carry signal is output and an output terminal (part connected to a scan line GL[n]) through which a scan signal is output are separated by two low-level power lines VSS1 and VSS2.

Since the shift register according to the second experimental example uses the two low-level power lines VSS1 and VSS2 to separate carry signals, gate falling time can be reduced. Here, a gate high voltage and a gate low voltage are repeated at the QB node and the pull-down transistor T7 is repeatedly turned on and off.

The QB node is charged (T7 is turned on) by being provided with a high-level voltage of the high-level power line VDD through a transistor T2I operating in response to an N-th clock signal of an N-th clock signal line CLK[N]. The QB node is discharged (T7 is turned off) by being provided with a first low-level voltage of the first low-level power line VSS1 through a transistor T3I operating in response to an (N+4)-th clock signal of an (N+4)-th clock signal line CLK[N+4]. Here, a transistor T2 operates for a period in which the voltage of the QB node is maintained as a gate high voltage so as to maintain a gate low voltage of the QB node.

Distinguished from the first embodiment, the shift register according to the second experimental example includes one pull-down transistor T7 which is repeatedly turned on and off. However, an unwanted gate floating (Vgout floating) may be generated during a turn off period of the pull-down transistor T7 as the shift register according to the second experimental example uses one pull-down transistor T7.

In addition, such a gate floating may cause a threshold voltage (Vth) shift of the pull-down transistor T7 during a long-term, high-temperature operation although the gate floating does not become a problem during a normal temperature operation. Accordingly, a gate low voltage supply capability of the pull-down transistor T7 may deteriorate (the gate low voltage is not maintained) due to a decrease of the on-current.

Second Embodiment

Figure 15:
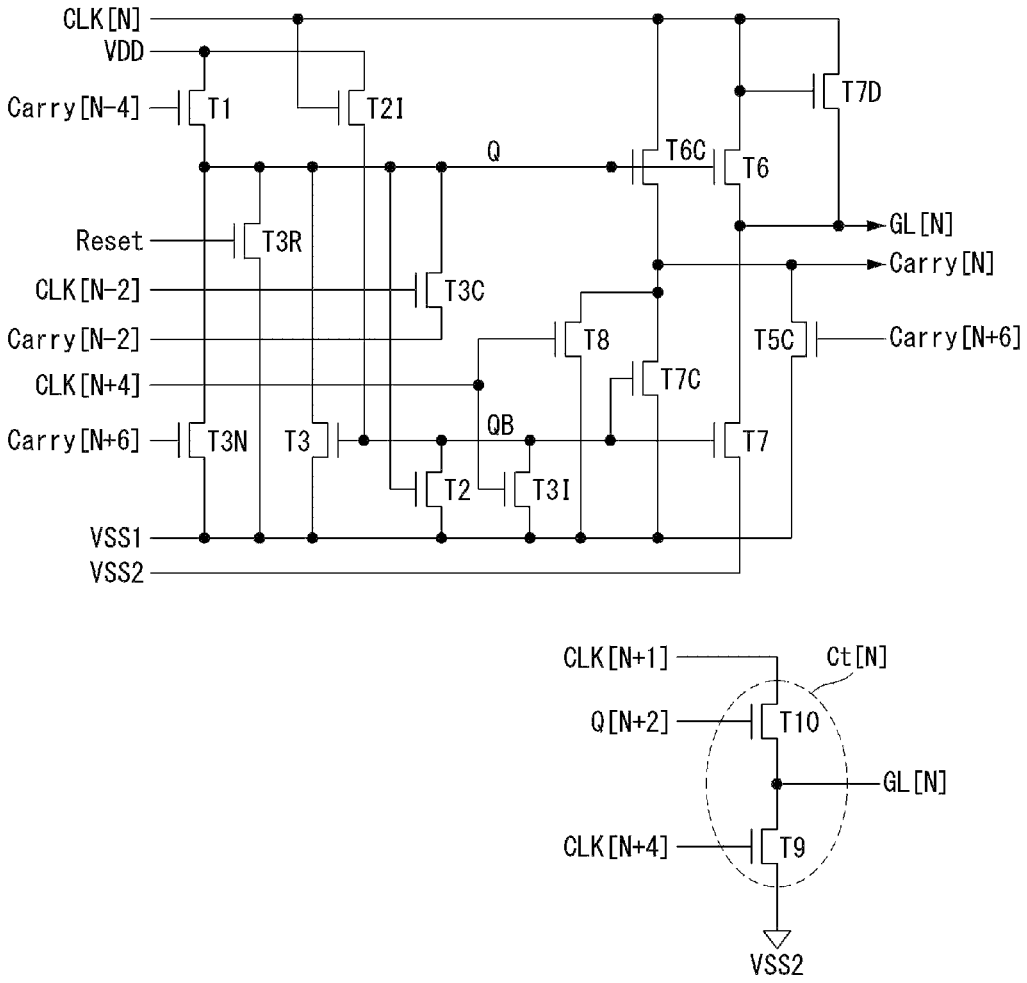
FIG. 15 illustrates a circuit of a principle part of a shift register according to the second embodiment of the present invention.
Figure 16:
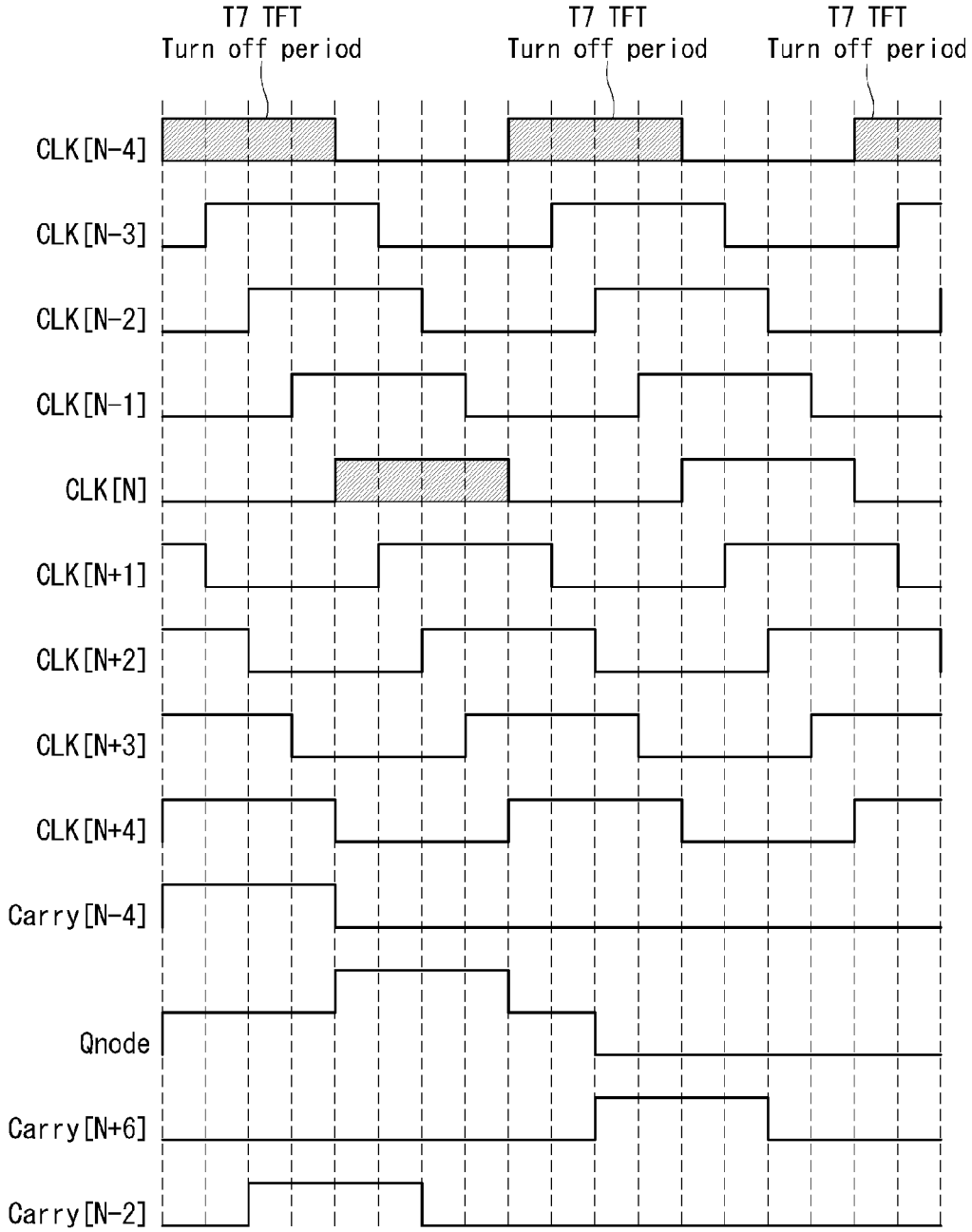
FIG. 16 illustrates driving waveforms of the shift register according to the second embodiment of the present invention.

FIG. 15 illustrates a circuit of a principal part of a shift register according to the second embodiment of the present invention, and FIG. 16 shows drive waveforms of the shift register according to the second embodiment of the present invention.

The shift register according to the second embodiment of the present invention includes the left and right shift registers 140L and 140R respectively formed in the left and right non-display areas LNA and RNA, as illustrated in FIG. 6.

As illustrated in FIG. 15, each shift register includes an N-th stage circuit unit T1 to T8 and an N-th compensation circuit unit Ct[N]. The N-th stage circuit unit T1 to T8 and the N-th compensation circuit unit Ct[N] are arranged on the left and right sides of the display area, opposite each other, and paired by being connected to an N-th scan line GL1. That is, the embedded scan driver is formed in such a manner that circuits, located at the first and second sides of the same scan line, are asymmetrical.

A description will be given on configurations of the N-th stage circuit unit T1 to T8 and the N-th compensation circuit unit Ct[N] and connection relationship therebetween.

The N-th stage circuit unit T1 to T8 includes a Q node controller, a QB node controller, and an output controller.

The Q node controller includes a transistor T1, a transistor T3, a transistor T3R, a transistor T3N and a transistor T3C.

The transistor T1 has a gate electrode connected to a carry output terminal Carry[N−4] of an (N−4)-th stage circuit unit, a first electrode connected to the high-level power line VDD and a second electrode connected to a Q node Q. The transistor T1 charges the Q node Q to a high-level voltage in response to the voltage of the carry output terminal Carry[N−4] of the (N−4)-th stage circuit unit.

The transistor T3 has a gate electrode connected to a QB node QB, a first electrode connected to the first low-level power line VSS1 and a second electrode connected to the Q node Q. The transistor T3 discharges the Q node Q to a first low-level voltage in response to the voltage of the QB node QB.

The transistor T3R has a gate electrode connected to a reset line Reset, a first electrode connected to the first low-level power line VSS1 and a second electrode connected to the Q node Q. The transistor T3R resets the Q node Q in response to a reset signal supplied through the reset line Reset.

The transistor T3N has a gate electrode connected to a carry output terminal Carry[N+6] of an (N+6)-th stage circuit unit, a first electrode connected to the first low-level power line VSS1 and a second electrode connected to the Q node Q. The transistor T3N discharges the Q node Q to the first low-level voltage in response to the voltage of the carry output terminal Carry[N+6] of the (N+6)th stage circuit unit.

The transistor T3C has a gate electrode connected to an (N−2)-th clock signal line CLK[N−2], a first electrode connected to a carry output terminal Carry[N−2] of an (N−2)-th stage circuit unit and a second electrode connected to the Q node Q. The transistor T3C charges and discharges the Q node Q in response to the voltage of the carry output terminal Carry[N−2] of the (N−2)-th stage circuit unit.

The QB node controller includes a transistor T2, a transistor T2I and a transistor T3I.

The transistor T2 has a gate electrode connected to the Q node, a first electrode connected to the first low-level power line VSS1 and a second electrode connected to the QB node QB. The transistor T2 discharges the QB node QB in response to the voltage of the Q node Q.

The transistor T2I has a gate electrode and a first electrode, which are connected to an N-th clock signal line CLK[N], and a second electrode connected to the QB node QB. The transistor T2I charges the QB node QB in response to the N-th clock signal of the N-th clock signal line CLK[N].

The transistor T3I has a gate electrode connected to an (N+4)-th clock signal line CLK[N+4], a first electrode connected to the first low-level power line VSS1 and a second electrode connected to the QB node QB. The transistor T3I discharges the QB node QB in response to an (N+4)-th clock signal of the (N+4)-th clock signal line CLK[N+4].

The output controller includes a transistor T5C, a transistor T6, a transistor T6C, a transistor T7, a transistor T7C and a transistor T7D. The transistors T6, T7 and T7D become an output terminal through which a scan signal is output. The transistors T5C, T6C and T7C become a carry output terminal through which a carry signal is output.

The transistor T6 has a gate electrode connected to the Q node Q, a first electrode connected to the N-th clock signal line CLK[N] and a second electrode connected to the output terminal of the N-th stage circuit unit. The transistor T6 serves to output a scan signal at a scan high voltage to the output terminal of the N-th stage circuit unit in response to the voltage of the Q node Q.

The transistor T7 has a gate electrode connected to the QB node QB, a first electrode connected to the second low-level power line VSS2 and a second electrode connected to the output terminal of the N-th stage circuit unit. The transistor T7 serves to output a scan signal at a scan low voltage to the output terminal of the N-th stage circuit unit in response to the voltage of the QB node QB. The transistor T7 is a pull-down transistor.

The transistor T7D has a gate electrode and a first electrode, which are connected to the N-th clock signal line CLK[N], and a second electrode connected to the output terminal of the N-th stage circuit unit. The transistor T7D serves to compensate for the transistor T6.

The transistor T5C has a gate electrode connected to the carry output terminal Carry[N+6] of the (N+6)-th stage circuit unit, a first electrode connected to the first low-level power line VSS1 and a second electrode connected to the carry output terminal Carry[N] of the N-th stage circuit unit. The transistor T5C serves to output a carry signal at the first low-level voltage in response to the voltage of the carry output terminal Carry[N+6] of the (N+6)-th stage circuit unit.

The transistor T6C has a gate electrode connected to the Q node Q, a first electrode connected to the N-th clock signal line CLK[N] and a second electrode connected to the carry output terminal Carry[N] of the N-th stage circuit unit. The transistor T6C serves to output a carry signal of the N-th clock signal in response to the voltage of the Q node Q.

The transistor T7C has a gate electrode connected to the QB node QB, a first electrode connected to the first low-level power line VSS1 and a second electrode connected to the carry output terminal Carry[N] of the N-th stage circuit unit. The transistor T7C serves to output a carry signal at the first low-level voltage in response to the voltage of the QB node QB.

The N-th compensation circuit unit Ct[N] includes a transistor T9 and a transistor T10. The transistor T9 is defined as a first compensation transistor and the transistor T10 is defined as a second compensation transistor.

The transistor T9 has a gate electrode connected to the (N+4)-th clock signal line CLK[N+4], a first electrode connected to the second low-level power line VSS2 and a second electrode connected to the end of the N-th scan line GL[N] located opposite the output terminal of the N-th stage circuit unit. The transistor T9 serves to supply the second low-level voltage through the end of the N-th scan line GL[N] coupled to the output terminal of the N-th stage circuit unit in response to the voltage of the (N+4)-th clock signal line CLK[N+4].

The transistor T10 has a gate electrode connected to the Q node Q[N+2] of the (N+2)-th stage circuit unit, a first electrode connected to the (N+1)-th clock signal line and a second electrode connected to the end of the N-th scan line GL[N] located opposite the output terminal of the N-th stage circuit unit. The transistor T10 serves to supply the (N+1)-th clock signal through the end of the N-th scan line GL[N] coupled to the output terminal of the N-th stage circuit unit in response to the voltage of the Q node Q[N+2] of the (N+2)-th stage circuit unit.

The aforementioned N-th stage circuit unit outputs a scan signal and a carry signal in response to the voltages of the Q node Q and the QB node QB. The QB node QB is charged with the high-level voltage of the high-level power line VDD, supplied through the transistor T2I operating in response to the N-th clock signal of the N-th clock signal line CLK[N] (T7 is turned on). The QB node QB is discharged by being provided with the first low-level voltage of the first low-level power line VSS1 through the transistor T3I operating in response to the (N+4)-th clock signal of the (N+4)-th clock signal line CLK[N+4] (T7 is turned off). Here, the transistor T2 operates during a period in which the voltage of the QB node QB is maintained as the gate high voltage so as to maintain the gate low voltage of the QB node QB.

In the aforementioned N-th stage circuit unit, a time when the transistor T7 is turned on in a period in which the scan low voltage of the QB node QB is maintained corresponds to a period in which the (N+4)-th clock signal is supplied as a logic high signal. Accordingly, the QB node QB needs to maintain the scan high voltage in order to maintain the output of the N-th stage circuit unit as the scan low voltage even during the period in which the (N+4)-th clock signal is supplied as the logic high signal. In this case, however, the transistor T7 is turned on all the time and thus the transistor T7 is degraded, decreasing circuit reliability.

However, when a compensation circuit provided to the opposite side of the display panel (position opposite the N-th stage circuit unit) is designed in the same configuration as the N-th compensation circuit unit Ct[N], as in the second embodiment of the present invention, the gate low voltage can be stably maintained. Specifically, since the transistor T9 is turned on in response to the (N+4)-th clock signal having a logic state opposite that of the N-th clock signal, the output of the N-th stage circuit unit can be maintained as the scan low voltage all the time.

The transistor T10 serves to improve propagation delay when a scan signal is output (refer to the first embodiment). When the compensation circuit unit is designed, the sizes of the transistor T9 and the transistor T10 can be set as T9<T10 in order to easily prevent the second low-level voltage from being transferred to the output terminal when the transistor T9 does not operate. While the sizes of the transistor T9 and the transistor T10 can be set with a ratio of 1:4 or more, the present invention is not limited thereto.

As described above, the second embodiment of the present invention can stably maintain the gate low voltage by removing a gate floating period using the compensation circuit unit.

In the meantime, two electrodes of a transistor, other than the gate electrode, may be source and drain electrodes and vice versa depending on connection directions. Accordingly, the two electrodes serving as the source and drain electrodes are represented as the first electrode and the second electrode in the present invention.

As described above, the embodiments of the present invention are directed to address various problems such as propagation delay and gate floating caused by characteristics of a scan driver embedded in a display device that has, for example, a high resolution and large screen size. The picture quality of the display device may also be improved by increasing the reliability of the embedded scan driver.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A display device, comprising:

a display panel having a display area and a non-display area outside the display area;

a data driver that supplies a data signal to the display panel; and a scan driver in the non-display area that includes a shift register of a plurality of stages and a level shifter, and that supplies a scan signal to the display panel using the shift register and the level shifter, wherein the shift register is arranged in an output terminal of an N-th stage circuit in a first non-display area and an output terminal of an N-th compensation circuit in a second non-display area that is in an opposite side of the first non-display area with the display area therebetween are paired and connected to an N-th scan line, wherein the N-th stage circuit outputs a first scan signal to the N-th scan line, and the N-th compensation circuit outputs a compensation signal to the N-th scan line in response to a node voltage of a stage circuit that outputs a second scan signal different from the first scan signal.

2. The display device of claim 1, wherein the N-th compensation circuit outputs the compensation signal to the N-th scan line in response to a voltage of a Q node of a stage circuit immediately adjacent thereto in a vertical direction.

3. The display device of claim 1, wherein the N-th compensation circuit outputs the compensation signal to the N-th scan line in response to voltages of Q nodes of a stage circuit in a stage prior thereto and a stage circuit in a stage before the prior stage or a stage circuit in a stage following the N-th compensation circuit and a stage circuit in a stage following the following stage.

4. The display device of claim 2, wherein the N-th compensation circuit outputs a clock signal as the compensation signal.

5. The display device of claim 1, wherein the N-th compensation circuit includes a compensation transistor having a gate electrode connected to a Q node of a stage circuit immediately adjacent thereto in a vertical direction, a first electrode connected to an N-th clock signal line, and a second electrode connected to the N-th scan line.

6. A scan driver, comprising:

a level shifter; and a shift register composed of a plurality of stages to generate a scan signal on the basis of a signal and power output from the level shifter, wherein the shift register includes an N-th stage circuit unit and an N-th compensation circuit unit located on the same line as the N-th stage circuit unit, the N-th stage circuit unit and the N-th compensation circuit unit being arranged to have asymmetrical circuit configurations, wherein an output terminal of the N-th stage circuit unit and an output terminal of the N-th compensation circuit unit are paired to be connected to an N-th scan line, wherein the N-th stage circuit outputs a first scan signal to the N-th scan line, and the N-th compensation circuit unit outputs a compensation signal to the N-th scan line in response to a node voltage of a stage circuit unit that outputs a second scan signal different from the first scan signal.

7. The scan driver of claim 6, wherein the N-th compensation circuit unit outputs the compensation signal to the N-th scan line in response to a voltage of a Q node of a stage circuit unit adjacent thereto in the vertical direction.

8. The scan driver of claim 6, wherein the N-th compensation circuit unit outputs the compensation signal to the N-th scan line in response to voltages of Q nodes of a stage circuit unit in a stage prior thereto and a stage circuit unit in a stage before the prior stage or a stage circuit unit in a stage following the N-th compensation circuit unit and a stage circuit unit in a stage following the following stage.

9. The scan driver of claim 7, wherein the N-th compensation circuit outputs a clock signal as the compensation signal.

10. The scan driver of claim 6, wherein the N-th compensation circuit includes a compensation transistor having a gate electrode connected to a Q node of a stage circuit unit adjacent thereto in the vertical direction, a first electrode connected to an N-th clock signal line, and a second electrode connected to the N-th scan line.

11. A display device, comprising:

a display panel;

a data driver configured to supply a data signal to the display panel; and a scan driver formed in a non-display area of the display panel, including a shift register composed of a plurality of stages and a level shifter formed outside the display panel, and configured to supply a scan signal to the display panel using the shift register and the level shifter, wherein the shift register is arranged in an output terminal of an N-th stage circuit unit formed in a first non-display area and an output terminal of an N-th compensation circuit unit formed in a second non-display area opposite the first non-display area are paired to be connected to an N-th scan line, wherein the N-th compensation circuit unit maintains the N-th scan line at a scan low voltage in response to a clock signal having a logic state opposite an N-th clock signal output through the output terminal of the N-th stage circuit unit.

12. The display device of claim 11, wherein the N-th compensation circuit unit maintains the N-th scan line at the scan low voltage corresponding to a low-level voltage output through the output terminal of the N-th stage circuit unit.

13. The display device of claim 11, wherein the N-th compensation circuit unit includes: a first compensation transistor having a gate electrode connected to a Q node of an (N+2)-th stage circuit unit, a first electrode connected to an (N+1)-th clock signal line, and a second electrode connected to the N-th scan line; and a second compensation transistor having a gate electrode connected to a clock signal line having a logic state opposite the N-th clock signal, a first electrode connected to a first or second low-level power line, and a second electrode connected to the N-th scan line.

14. A scan driver, comprising:

a level shifter; and a shift register composed of a plurality of stages to generate a scan signal on the basis of a signal and power output from the level shifter, wherein the shift register includes an N-th stage circuit unit and an N-th compensation circuit unit located on the same line as the N-th stage circuit unit, the N-th stage circuit unit and the N-th compensation circuit unit being arranged to have asymmetrical circuit configurations, wherein an output terminal of the N-th stage circuit unit and an output terminal of the N-th compensation circuit unit are paired to be connected to an N-th scan line, wherein the N-th compensation circuit unit maintains the N-th scan line at a scan low voltage in response to a clock signal having a logic state opposite an N-th clock signal output through the output terminal of the N-th stage circuit unit.

15. The scan driver of claim 14, wherein the N-th compensation circuit unit maintains the N-th scan line at the scan low voltage corresponding to a low-level voltage output through the output terminal of the N-th stage circuit unit.

16. The scan driver of claim 14, wherein the N-th compensation circuit unit includes: a first compensation transistor having a gate electrode connected to a Q node of an (N+2)-th stage circuit unit, a first electrode connected to an (N+1)-th clock signal line, and a second electrode connected to the N-th scan line; and a second compensation transistor having a gate electrode connected to a clock signal line having a logic state opposite the N-th clock signal, a first electrode connected to a first or second low-level power line, and a second electrode connected to the N-th scan line.

* * * * *